United States Patent [19]

Sullivan et al.

[11] 3,973,575

[45] Aug. 10, 1976

[54] MINING CONCENTRATOR

[75] Inventors: Arthur Francis Sullivan, Redmond; Frank Howard Brockett, III, Bellevue, both of Wash.

[73] Assignee: The International Nickel Company, Inc., New York, N.Y.

[22] Filed: Dec. 11, 1974

[21] Appl. No.: 531,780

[52] U.S. Cl. ..... 37/58; 37/55; 37/57; 37/DIG. 8; 43/6.5; 171/65; 171/102; 299/8

[51] Int. Cl.[2] ..... E02F 7/00; E02F 3/92; E02F 3/94

[58] Field of Search ..... 43/6.5; 56/8, 9; 171/63, 18, 65, 102; 37/54, 55, 57, 58, 71, DIG. 8; 299/8, 9

[56] References Cited

UNITED STATES PATENTS

| | | | |
|---|---|---|---|
| 216,061 | 6/1879 | Shaw | 37/58 |
| 371,686 | 10/1887 | Howell | 37/58 |
| 611,614 | 10/1898 | Edwards | 37/58 |
| 875,420 | 12/1907 | Frayer | 37/58 |
| 3,184,866 | 5/1965 | McMillin | 37/55 |
| 3,226,854 | 1/1966 | Mero | 37/55 X |
| 3,305,950 | 2/1967 | Hirshman et al. | 37/DIG. 8 |
| 3,310,894 | 3/1967 | Ball | 37/DIG. 8 |
| 3,440,752 | 4/1969 | Minter | 43/6.5 |
| 3,588,174 | 6/1971 | Rossfelder | 37/DIG. 8 |
| 3,624,932 | 12/1971 | Doyle | 37/55 |

FOREIGN PATENTS OR APPLICATIONS

| | | | |
|---|---|---|---|
| 525,744 | 9/1940 | United Kingdom | 37/58 |
| 1,156,547 | 6/1969 | United Kingdom | 37/55 |

*Primary Examiner*—Edgar S. Burr
*Assistant Examiner*—Steven A. Bratlie
*Attorney, Agent, or Firm*—George N. Ziegler; Ewan C. MacQueen; Raymond J. Kenny

[57] ABSTRACT

Vehicle adapted for being towed along undersea floor area where desired mineral aggregates, such as manganese nodules, are dispersed on ocean bottom carries horizontally fenestrated sweeps and hydraulic transition chamber utilizing towed motion and hydraulic suction for acquiring, concentrating and transmitting desired aggregates to conduit for upward transport.

10 Claims, 7 Drawing Figures

MINING CONCENTRATOR

The present invention relates to obtaining solid minerals and more particularly to underwater mining.

Heretofore, desirable mineral aggregates have been found underwater, and many metallurgic and economic studies have indicated that substantial amounts of useful minerals are present as solid mineral aggregates, e.g., manganese nodules, on deep ocean floors. In many instances the aggregates are found dispersed over wide areas of the sea floor and although apparatus, such as suction conduits, has been devised for raising ore aggregates from the sea floor to a mining ship, there are needs for means to concentrate the dispersed, and desired, aggregates for efficient transportation up to the sea surface. Problems of providing an undersea mineral concentrator are made particularly difficult by the remoteness of the operation and the vastness of the ocean floor area and also by lack of precise knowledge of the features of the terrain that will be encountered in a specific operation, albeit some information obtained by geologic sampling and undersea television. Thus, an ocean floor vehicle must sustain happenstance encounter with very liquid soft areas, or viscous mud and sediment, or against hard unyielding obstructions. And solid materials may be encountered in forms of undesirably fine particles or practically untransportable large lumps.

It is desirable to prepare, for upward transport, a mineral concentration restricted to only the desired aggregates in order to avoid waste of transport energy and excessive pollution of the upper sea levels.

There has now been discovered an undersea minerals concentrating vehicle that enables providing concentrations of desired mineral aggregates for upward transport to mining ships.

An object of the present invention is to provide an undersea mineral concentrating vehicle.

Other objects and advantages of the invention will be apparent from the following description taken in conjunction with the accompanying drawing wherein.

Figure 1:
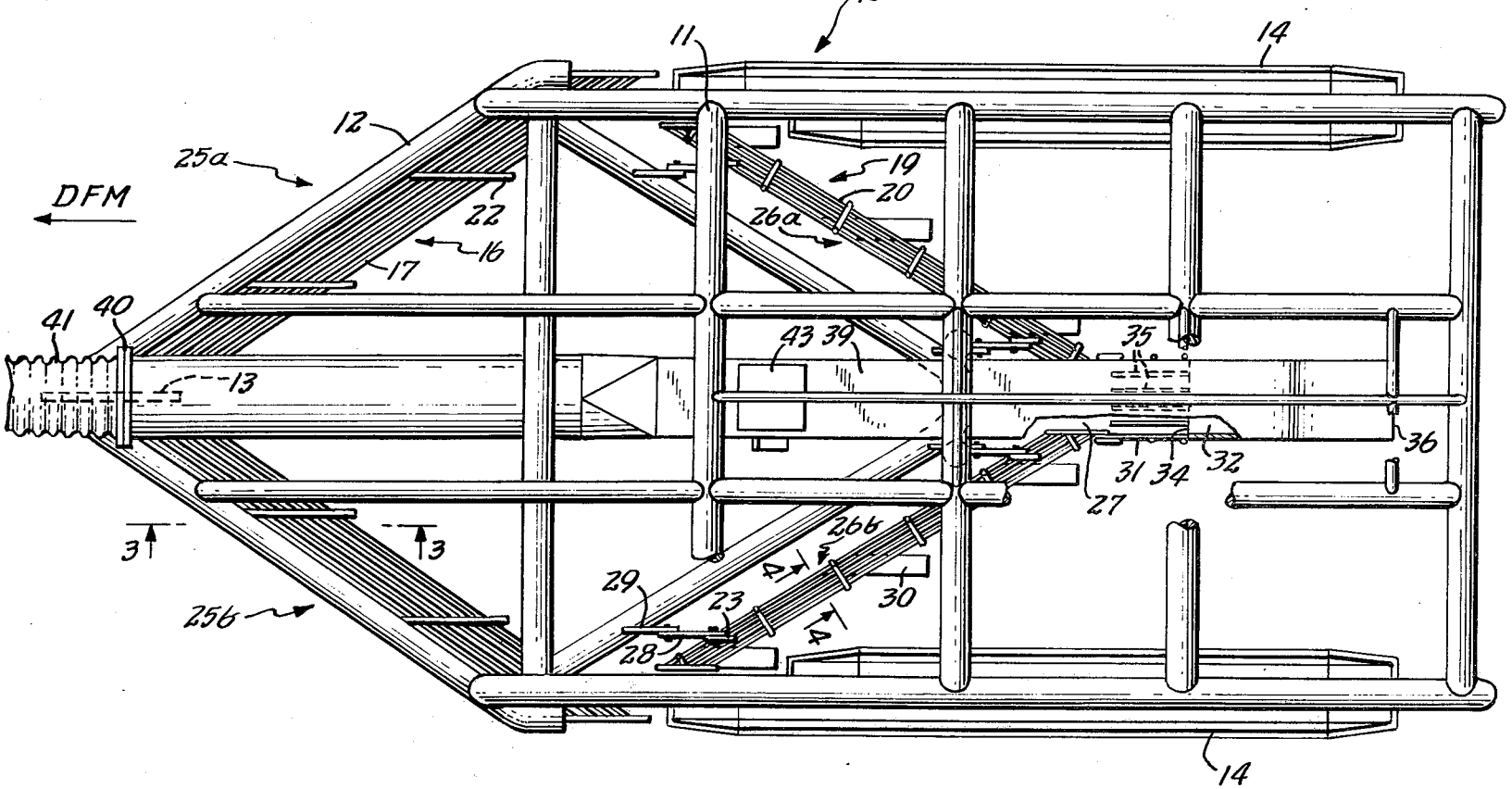
FIG. 1 is a plan view of an embodiment of the vehicle of the invention.

Briefly, the present invention contemplates an undersea mineral concentrating vehicle adapted for being moved in a forward direction on an undersea floor and having two horizontally fenestrated sweeps disposed one in front of the other, a special hydraulic flow transition chamber, referred to at some places hereinafter as a tail pipe, following the sweeps and joined to a hydraulic suction conveyance duct extending forward from the tail pipe. The sweeps have bars arranged horizontally to concentrate desired sizes of undersea solids into a windrow. The transition tail pipe has a frontal opening disposed for entrance of solids from the sweeps, an aft entrance for forward suction of sea water, and a forwardly and upwardly directed exit for transmission of solids and water to the suction conveyance duct.

Each sweep comprises a pair of wings and each wing has a plurality of bars that are fixed in horizontal and vertically spaced apart positions parallel to one another. The wings of the forward sweep are swept back to diverge in the form of a forwardly pointed, rearwardly open Vee (when viewed from above). The vertical spacing of the horizontal bars in the diverging wings is sufficiently close to prevent passage of, and to reject, oversize solids, e.g., rocks, lumps, and undesirably large aggregates, and yet are spaced sufficiently far apart to provide fenestrations that are large enough to permit passage of desired sizes of aggregates. Inasmuch as the forward, divergent sweep has bars positioned to reject oversize solids, it is referred to herein as the rejection sweep.

Behind the rejection sweep is another sweep, referred to as the collection sweep, which comprises a pair of horizontally fenestrated wings disposed in the form of a forwardly open Vee with the wings converging rearwardly to a rear exit that is transversely shorter than the forward opening of the Vee. Collection of oversize solids is avoided by having the rejection sweep wings extend transversely at least as wide as the collection Vee opening. Desired sizes of solids are pushed inward by and slide along the horizontal collection bars toward the interior of the Vee while undesired fine material passes outward through the fenestrations. Accordingly, as the vehicle slides forward, the sweeps form a windrow of aggregates of desirable sizes at the rear exit of the collection sweep.

Directly aft the collection sweep exit, the vehicle moves the tail pipe into the windrow of desired aggregates. The solids entrance of the tail pipe, which advantageously has a flat baseplate, is supported at or a small distance above the undersea floorline. It is understood that many of the sea bottom areas that are of particular interest herein are largely covered with soft fluid-like sedimentary material, e.g., silt, and have a relatively firm floor beneath the soft material. For use on such areas, the bottom of the tail pipe entrance can be disposed at or above the floorline by having the tail pipe supported from a framework mounted on sliding runners adapted to sink into the soft material and slide on the surface of the more firm material (the sea floor) and with the framework adapted in correlation with the runners and other components of the vehicle, to hold the entrance bottom at least as high as the floorline. Supporting the solids entrance at, or a small height above, and not below, the floorline is a good feature that aids in avoiding plowing up the subfloor material and avoiding overloading or clogging the pipe, conduit or riser with excessive amounts of subfloor solids and also avoids excessive environmental disturbance.

As the vehicle continues to move forward, the baseplate separates the windrow from the sea floor and then the pipe brings a forward/upward flow of water over the solid material in the windrow and moves it up into the conveyance duct. The forward flow of water enters at an opening at the aft end of the tail pipe. The forward flow is powered by suction from a riser or other transport duct attached to the conveyance duct. The aft entrance to the pipe has a transverse cross-sectional area that is larger, e.g., 2 to 3 times larger, than the interior cross-section of the conveyance duct and provides for the water velocity at the aft entrance being slower than the conduit water velocity in the conveyance duct. The interior cross-sectional area of the tail pipe is reduced, at a portion referred to as the throat and located between the aft entrance (for water) and the forward entrance (for solids), to an area equal to the cross-section of the conveyance duct. The floor of the water entrance and the solids entrance are coextensive. Between the throat and the solids entrance, the pipe has a forwardly and upwardly directed port that leads into the conveyance duct. Thus, water flow is forward from the aft entrance, through the throat and up into the conveyance duct, while solids flow into the forward entrance and up into the conveyance duct. The water flow rate depends upon the suction from the transport duct connected to the conveyance duct. For instance, the water flow rate can be changed by changing of the speed of riser suction pumps. The solids flow rate depends upon the forward speed of the tail pipe and may, for instance, be changed by changing the speed of towing the vehicle. Desirably, the water flow through the pipe conveys the solids up into the conveyance duct before the solids reach the throat. However, if, undesirably, a build-up of solids commences in the throat, the water velocity in the throat will be increased due to the reduction of the open cross-sectional area in the throat, and the increased water velocity will provide erosive capability for clearing the throat. In this respect, the tail pipe has self-regulating capability for maintaining the water passage open without requiring changing the pumping or towing speed.

Advantageously, the exit port or the exit port-conveyance duct junction is at an angle of about 5° to 45°, or possibly 60°, e.g., 15° or 30°, forwardly upward from the horizontal in the direction of forward movement of the pipe. Also of advantage, the forward entrance, throat and aft entrance are longitudinally aligned with the direction of forward movement, the baseplate is flat and held parallel to the bottom surfaces of the runners, and the cross-sectional area of the solids entrance is about ½ to ¾ times the cross-sectional area of the conveyance duct.

Figure 2:
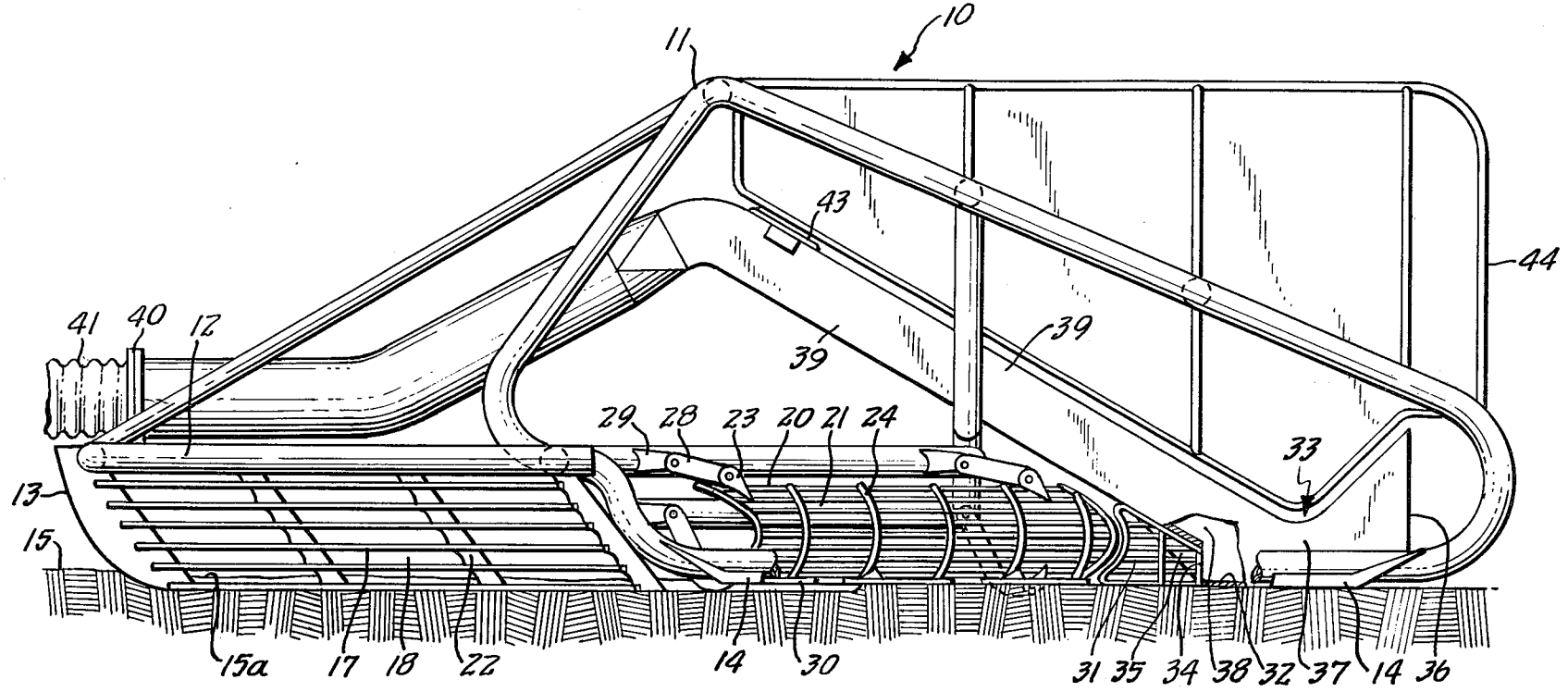
FIG. 2 is a side view of the embodiment of FIG. 1.

Referring now to the drawing, FIGS. 1 and 2 depict an undersea mining vehicle which is designated generally by numeral 10. Mining vehicle 10, adapted for forward movement in a direction indicated by arrow DFM, includes support and rollbar framework 11, with bumper 12 and pavement rider 13, mounted on sliding runners 14 to enable moving the vehicle along ocean floor 15, e.g., by towing. Diverging horizontally fenestrated sweep 16 includes rejection bars 17 which are connected to the rider and bumper. The rejection bars are oriented horizontally and divergent rearwardly away from the vehicle center line and are vertically spaced apart to form mineral passage fenestrations 18 that are of a size sufficiently open for enabling passage of desired sizes of mineral aggregates, e.g., about ⅛ inch to 2 inches, and sufficiently closed for blocking passage of undesirably large aggregates or other large solids. Aft of the diverging sweep, converging horizontally fenestrated sweep 19 includes collection bars 20 which are oriented horizontally and convergent rearwardly toward the vehicle center line and are vertically spaced apart to form fines emission fenestrations 21 that are of a size sufficiently close for preventing passage of desired sizes of aggregates while providing openings that enable passage of undesirably small particles and fine sediment for emission outward toward the rear of the vehicle. The rejection bars are held by rejection bar supports 22, and the collecting bars are held by external padeyes 23 and curved external ribs 24, the bars being welded to the respective supports, padeyes and ribs. Referring to the plan view of FIG. 1 it is to be noted that the diverging sweep extends rearwardly outward as a rearward open Vee and that the converging sweep extends rearwardly inward. Wings **25*a* and 25*b* of the diverging rejection sweep extend sideward beyond the frontal opening of wings 26*a* and 26*b* of the converging collection sweep. The collection wings converge to sweep exit 27.**

Advantageously, the rejection sweep wings are angled outward and the collection wings are angled inward at least about 20°, advantageously 25° to 45°, e.g., 30°, from the direction of forward movement of the vehicle.

The rejection bars are disposed with the uppermost being the most forward, whereas the collection bars are disposed in an inwardly concave structural pattern for benefiting collection of desired aggregates.

Figure 3:
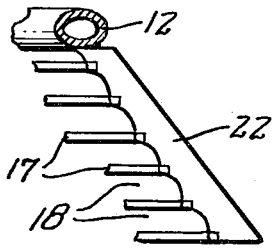
FIG. 3 is a detail view, on an enlarged scale, of a vertical cross section on line 3—3 of FIG. 1.

A cross-section view of the bars and fenestrations in a wing of the rejection sweep, taken across line 3—3 on FIG. 1, is illustrated by FIG. 3.

Figure 4:
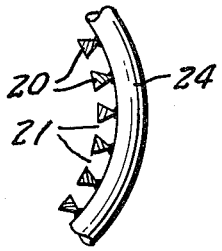
FIG. 4 is a detail view, on an enlarged scale, of a vertical cross section on line 4—4 of FIG. 1.
Figure 5:
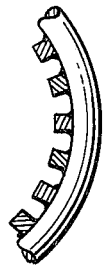
FIG. 5 is an illustrative depiction of a variation of the structure of FIG. 4.

A cross-section view of the bars and fenestrations in a wing of the collection sweep, which has triangular wedgewire retaining bars with apexes pointed outwardly to provide rearwardly increasing fenestration sizing, is illustrated by FIG. 4, taken across line 4—4 on FIG. 1. Also, FIG. 5 depicts from a cross-sectional viewpoint another useable arrangement of retaining bars wherein the bars have rectangular cross-sections and, in view of the inwardly concave arrangement, the openings of the fenestrations between the bars increase rearwardly (and outwardly). The rearwardly increasing configuration of the openings is desirably provided to aid in avoiding clogging of the fenestrations.

The collecting sweep wings are pivotally connected to the vehicle framework with arms 28 attached with pivot pins at each end in frame padeyes 29 and in the collecting wing padeyes to enable vertical swinging of the arms and thereby enable the collection wings, which have attached thereto gliders 30, to move (or "float") up and down when the vehicle is passing over surface irregularities such as projections, depressions or soft spots of the undersea floor. With respect to this capability of the sweeping wings to move vertically in relation to, and to a useful extent independently of, the horizontal path of the main frame on the outboard sliding runners, the movably connected collection sweep is referred to as a floating sweep. The floating action enables sweeping close to, above or below, the siltline (**15*a***), aids in avoiding or overcoming forward build-up of excessive sediments in a bow-wave and enables riding over hard projections. Where desired, the floating sweep can be mounted with a track and captive roller assembly, instead of the arm and padeye linkage, to enable the sweep to move up and down relative to the main frame structure.

Figure 7:
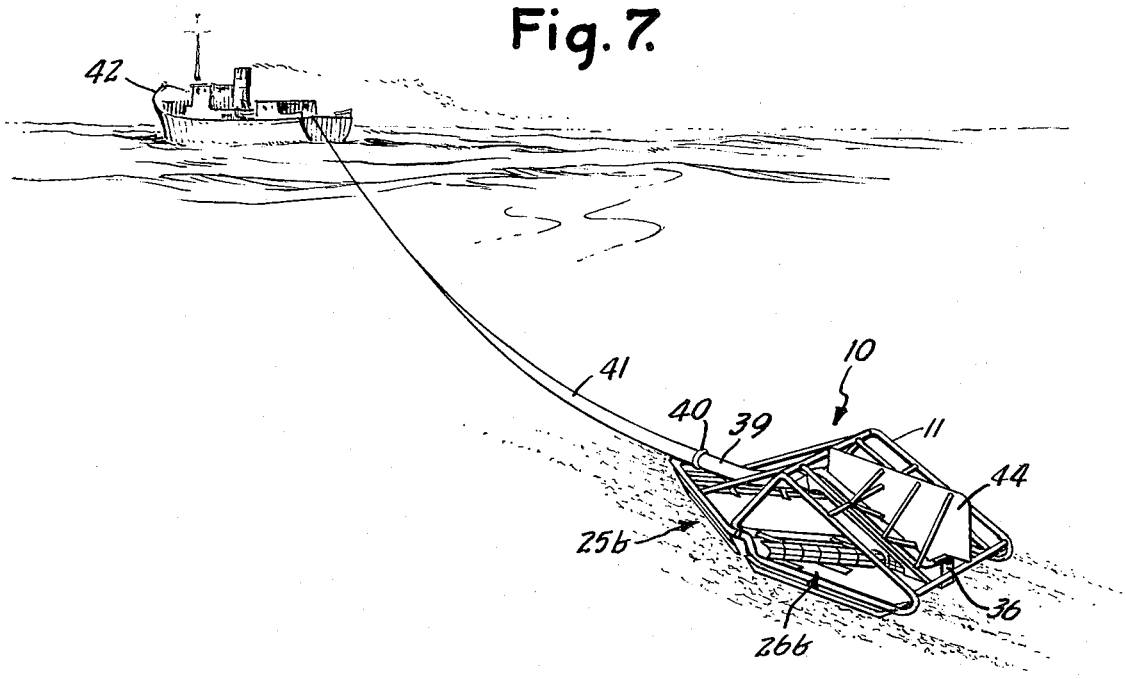
FIG. 7 is a perspective illustration of an embodiment of the vehicle of the invention deployed for undersea mining in conjunction with a surface ship.

When the vehicle is sliding over a sea floor of silt, sediment, mud or the like in a region where mineral ores are present in modestly sized aggregates, such as manganese nodules dispersed at the floor surface, the forward movement of the diverging rejection sweep and the converging collection sweep serves to provide a concentrated windrow of desired sizes of aggregates at the sweep exit. As the vehicle moves forward, the windrowed solids are confined by side screens 31 and are separated from the sea floor by baseplate 32 of transition tail pipe duct 33 and then are taken into the tail pipe at solids entrance 34, a rectangular opening with rejection teeth 35 in front to prevent entrance of any oversize solids that might perchance be passed by the rejection sweep period. The framework supports the tail pipe at a height where the tail pipe baseplate is at the level of the bottom surfaces of the sliding runners. Water entry 36 provides an aft entrance for a forward flow of water through throat 37 of the tail pipe to convey desirably sized aggregates from the solids entrance up through transition port 38 and into suction conveyance duct 39. The conveyance duct is connected at joint 40 to transport conduit 41, a suction riser, that leads up to the mining ship 42. (See FIG. 7) Pumps for moving a suction flow through the ducts can be on the mining ship and also in or on the ductwork. The vehicle can be towed along the undersea floor by pulling with the transport conduit.

When it is desired to draw clear, relatively free from sea floor material, water through the ducting, such as when starting up or shutting down the pumping system, water can be drawn from above and forward of the tail pipe by opening the cover at elevated water gate 43 with remote control by communication, e.g., electric or acoustic, from a surface ship.

Vertical vane 44 aids aligning the vehicle with the tow path and may also aid protection against accidental rollover.

Figure 6:
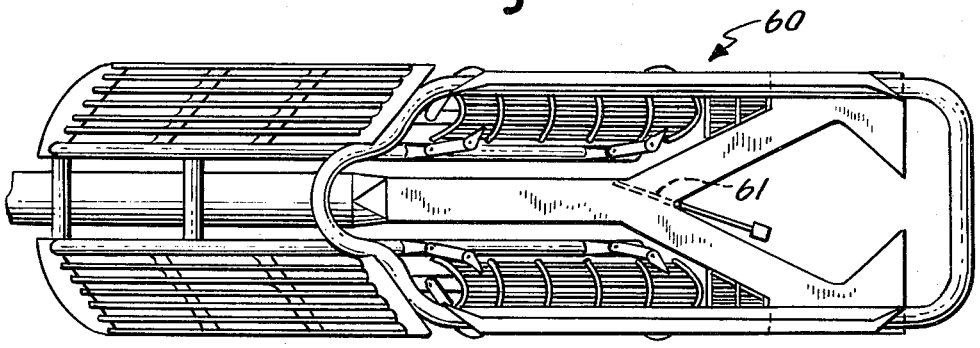
FIG. 6 is a side view of an invertible duplex version of the vehicle of FIGS. 1 and 2.

Another embodiment, vehicle 60 depicted in FIG. 6, is without a guide vane or rollover bar and has the horizontal conveyance duct aligned horizontally a small distance above the sweeps and also, in addition, has above the conduit an inverted duplicate mirror-image arrangement of the rejection sweep, collection sweep and transition duct of FIGS. 1 and 2, with both transition ducts adapted to feed alternatively to the horizontal conveyance duct according to whether the vehicle, when lowered from the sea surface to the sea floor, lands on the floor in the orientation depicted by FIG. 6, or, alternatively, lands 180°-inversely (upside down) to the FIG. 6 orientation, in order to enable the vehicle to function effectively in either orientation. Gravity operated door 61 is adapted to be open to the lower most conveyance duct and closed to the upper duct according to the way the vehicle descends onto the ocean floor. If desired, the duct door may be provided with a remotely controllable actuator.

The present invention is particularly applicable to the gathering, concentrating and upwardly transporting of manganese nodules dispersed on deep ocean floors and is also applicable to the mining of other mineral aggregates dispersed on underwater floors. Furthermore, for such important matters as conserving and avoiding pollution of the natural environment and conserving energy, the invention provides benefits of enabling concentrating desired solid minerals at the sea floor in preparation for conveyance to the sea surface efficiently, with conservation of energy, by restricting the amount of undesired material that is transported to the upper levels of the sea.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. Undersea mining apparatus for obtaining a concentration of desired sizes of mineral aggregates from an undersea floor where the desired aggregates are dispersed in a mixture with other solid materials at the surface of the undersea floor comprising:

a. a vehicle structure including means for being moved in a forward direction on an undersea floor;

b. a rearwardly diverging horizontally fenestrated rejection sweep rigidly fixed to the vehicle structure, said rejection sweep comprising two rejection wings each having a plurality of rejection bars and a plurality of rejection bars supports holding the rejection bars in mutually parallel horizontal positions vertically spaced sufficiently apart to permit passage of desired aggregates, characterized by desired sizes, and sufficiently close to each other to reject passage of undesirably large solids, said rejection wings being fixed to the vehicle structure in the configuration of a rearwardly diverging vee with the apex pointed toward the forward direction and with an opening between the rearwardly diverging wings aft of the apex;

c. a rearwardly converging horizontally fenestrated collection sweep disposed behind the rejection sweep, said collection sweep comprising two collection wings each having a plurality of collection bars and a plurality of collection bar ribs holding the collection bars in mutually parallel horizontal positions vertically spaced sufficiently apart to permit passage of undesirably fine particles and sufficiently close to each other to prevent passage of desired aggregates, said collection wings being connected to the vehicle structure with a movable attachment means for providing vertically floating movability of the collection sweep wings in relation to the vehicle structure and for holding the collection wings in the configuration of a rearwardly converging vee having the opening between the wings of the vee located collection forward of the apex of the vee and with the forward opening between the collection sweep wings disposed behind the aft opening of the rejection sweep wings and between the rejection sweep wings and said collection sweep having a rearwardly open exit aft of said forward opening between the collection sweep wings; and d. a liquid-solid flow transition chamber supported by the vehicle structure and disposed directly aft of the collection sweep exit, said chamber having a solids entrance facing forward toward the collection sweep exit, a water entrance facing aft and an exit port, said solids entrance and water entrance being disposed at least as high as the lowermost portion of the rejection sweep and said exit port being disposed higher than the solids entrance, said solids entrance and exit port being sufficiently open to enable passage of desired aggregates, and junction means for joining the exit port to a hydraulic suction conduit and for enabling upward suction of solids and water from the aforesaid solids entrance and water entrance.

2. Apparatus as set forth in claim 1 wherein the vehicle structure means for being moved comprises two sliding runners disposed one at either side of the apparatus, aligned parallel to the direction of forward movement, and having the apparatus mounted thereon.

3. Apparatus as set forth in claim 1 whereon each collection sweep wing has connected thereto, and disposed below the collection bars of the wing, a sliding glider for riding at the undersea floorline.

4. Apparatus as set forth in claim 1 wherein the rejection sweep wings are each inclined in the range from about 25° to about 45° horizontally outwardly from the longitudinal centerline of the vehicle structure.

5. Apparatus as set forth in claim 1 wherein the collection sweep wings are each inclined in the range from about 25° to about 45° horizontally inwardly toward and with respect to the longitudinal centerline of the vehicle structure.

6. Apparatus as set forth in claim 1 wherein the vertically spaced rejection bars of each rejection wing are disposed in a rearwardly downwardly sloping arrangement with the uppermost rejection bar being the most forward of the rejection bars in the wing.

7. Apparatus as set forth in claim 1 wherein the collection bar ribs of each collection wing hold the collection bars disposed in a structural pattern having a vertical cross-section concave toward the other collection wing and the collection bars extend inward from the ribs and provide continuous upward facing surfaces inward of the rib mountings said continuous surfaces being sufficient to enable smooth unobstructed movement of desired sizes of aggregates along the collection bars and to the exit.

8. Apparatus as set forth in claim 1 wherein the solids entrance has barriers for rejecting entry of oversize solids.

9. Apparatus as set forth in claim 1 wherein the vertically movable attachment of the collecting sweep wings comprises an arm, pivot pin and padeye linkage connecting the wings to rigidly fixed components of the vehicle.

10. Apparatus as set forth in claim 1 having a hydraulic conveyance duct joined to the exit port of the transition chamber and extending, in relation to the direction of forward movement on the undersea floor, forwardly and upwardly from the chamber and having a remotely controllable water entry gate for enabling drawing into the duct water from above and in front of the chamber.

* * * * *

UNITED STATES PATENT OFFICE

CERTIFICATE OF CORRECTION

PATENT NO. : 3,973,575

DATED : August 10, 1976

INVENTOR(S) : ARTHUR FRANCIS SULLIVAN and FRANK HOWARD BROCKETT III

It is certified that error appears in the above-identified patent and that said Letters Patent are hereby corrected as shown below:

Column 6, lines 39 and 40(lines 38 and 39 of claim 1) for "converging vee having the opening between the wings of the vee located collection forward of the" should read --converging vee having the opening between the collection wings of the vee located forward of the--.

Signed and Sealed this

Seventh Day of December 1976

[SEAL]

*Attest:*

RUTH C. MASON
*Attesting Officer*

C. MARSHALL DANN
*Commissioner of Patents and Trademarks*